US007410368B2

(12) United States Patent
Lappoehn

(10) Patent No.: US 7,410,368 B2
(45) Date of Patent: Aug. 12, 2008

(54) PLUG CONNECTION ADAPTER

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/688,612

(22) Filed: Mar. 20, 2007

(65) Prior Publication Data

US 2007/0224850 A1 Sep. 27, 2007

(30) Foreign Application Priority Data

Mar. 21, 2006 (DE) ..... 10 2006 013 281

(51) Int. Cl.
*H01R 12/00* (2006.01)

(52) U.S. Cl. ..... 439/76.1

(58) Field of Classification Search ..... 439/79–81, 439/76.1, 607–610, 92, 108, 78, 378, 554, 439/82–83, 680
See application file for complete search history.

(56) References Cited

U.S. PATENT DOCUMENTS 4,173,387 A * 11/1979 Zell ..... 439/557
4,376,565 A * 3/1983 Bird et al. ..... 439/681
4,686,607 A * 8/1987 Johnson ..... 361/788
5,133,679 A * 7/1992 Fusselman et al. ..... 439/608
6,986,671 B2 * 1/2006 Margulis et al. ..... 439/78
2001/0006854 A1 * 7/2001 Moriwake et al. ..... 439/78
2002/0142631 A1 10/2002 Chang

FOREIGN PATENT DOCUMENTS

DE 19947031 3/2001
DE 20109922 9/2001
EP 0945934 9/1999

* cited by examiner

*Primary Examiner*—Edwin A. León
(74) *Attorney, Agent, or Firm*—Collard & Roe, P.C.

(57) ABSTRACT

In a plug connection adapter adapted for connecting a first and a second plug-in connector element (11, 12) and comprising at least one contact pin (17) both ends of which are provided with contact blades/contact slots (21*a*, 21*b*) for contact-making of the plug-in connector elements (11, 12), a header shroud (16*a*, 16*b*) adapted to guide the plug connection adapter (10) when contacting a plug-in connector element (11, 12) is arranged on at least one end of the plug connection adapter (10).

9 Claims, 8 Drawing Sheets

PLUG CONNECTION ADAPTER

CROSS REFERENCE TO RELATED APPLICATIONS

Applicant claims priority under 35 U.S.C. §119 of German application No. 10 2006 013281.5 filed Mar. 21, 2006.

The present invention relates to a plug connection adapter according to the preamble of the independent Claim.

PRIOR ART

Plug-in connections for printed-wiring boards are offered by Applicant in a variety of different designs. A plug-in connection for printed-wiring boards comprises two plug-in connector elements that can be brought into engagement one with the other. A plug-in connector element generally comprises a plurality of electrically conductive contacts arranged in a plastic housing. A first plug-in connector element is arranged on the printed-wiring board. For connecting the printed-wiring board with other wiring components the second plug-in connector element is plugged onto the first plug-in connector element.

The second plug-in connector element may be connected to another plug-in connector element via a ribbon cable, for example, which can be fitted in a corresponding plug-in connector element arranged on another component.

DE 199 47 031 A describes a plug-in connector for printed-wiring boards arranged for connecting a first printed-wiring board to a second printed-wiring board that can be fitted on it in substantially vertical position, and where an electric connector provided on the second printed-wiring board can be brought into contact with the plug-in connector of the printed-wiring board. A U-shaped seat is arranged on the plug-in connector of the printed-wiring board for centering the second printed-wiring board. In order to permit second printed-wiring boards of different thickness to be received in the plug-in connector of the printed-wiring board, the U-shaped seat is provided with an adapter means by which the width of the U-shaped seat can be adapted to the thickness of the second printed-wiring board.

In the case of the proposed plug-in connector for printed-wiring boards, a first plug-in connector of a printed-wiring board, adapted to directly contact the second printed-wiring board, is arranged on the first printed-wiring board only. The fact that the second plug-in connector for printed-wiring boards is missing on the second printed-wiring board on the one hand saves the costs of the second plug-in connector for printed-wiring boards, while restricting on the other hand the mounting conditions for the second printed-wiring board, relative to the first printed-wiring board.

Plug-in connector elements that do not have a plastic housing and which, therefore, are known as pinheaders, are used especially in computer engineering. The pinheaders may on the one hand be connected to the printed-wiring board by soldering. In cases where the contact pins, being fixed in position by a narrow plastic strip, are provided with contact blades for making contact with plug-in connector elements on both sides, the pinheaders may be used as plug connection adapters between two plug-in connector elements.

The exposed contact pins may easily produce short circuits between the contact pins during handling of the pinheaders or during assembly work performed near the pinheaders.

If a larger number of contact pins is provided, which in addition may be relatively long, mating with another plug-in connector element may prove to be difficult. If the contact pins are arranged in two rows, it may happen that the plug-in connector element to be contacted will establish contact only with one row of contact pins. Especially, the plug-in connector element to be contacted may unintentionally be fitted in a laterally offset position, in the lengthwise direction.

Now, it is the object of the present invention to provide a plug-in connector adapted for easy and reliable assembly.

This object is achieved by the features defined in the independent Claim.

DISCLOSURE OF THE INVENTION

The plug connection adapter according to the invention, adapted for connecting a first and a second plug-in connector element and comprising at least one contact pin both ends of which are provided with contact blades/contact slots for contact-making of the plug-in connector elements, provides that a header shroud adapted to guide the plug connection adapter when contacting a plug-in connector element is arranged on at least one end of the plug connection adapter.

The header shroud makes assembly of the plug connection adapter with the plug-in connector element to be contacted easy and reliable by providing a safe guide for the contact pins during mating.

The plug connection adapter is suited especially for automatic assembly. In particular, the plug connection adapter according to the invention allows two printed-wiring boards, each provided with plug-in connector elements, to be electrically connected at a defined spacing and/or in defined orientation/at a defined angle, and also allows the spacing and the orientation/the angle to vary within a wide range.

Advantageous further developments and embodiments of the plug connection adapter according to the invention will be apparent from the dependent Claims.

One embodiment provides that a header shroud is arranged on both ends of the plug connection adapter. With the aid of this feature, the advantages of the header shroud can be achieved for both plug-in connector elements during contacting.

One embodiment provides that the contact pins comprise narrower portions for pushing-on the header shroud. The contact pin portions of greater cross-section outside the header shroud, corresponding to the narrower portions, on the one hand improve the mechanical stability and on the other hand allow low ohmic resistance and low inductive reactance to be realized for the electric connection.

Another embodiment provides that the header shroud comprises at least one sloping edge at the forward end intended to facilitate the operation of pushing the shroud onto a plug-in connector element. The sloping edge permits the plug connection adapter to be centered relative to the plug-in connector element, thereby facilitating the fitting operation.

A further embodiment provides that the header shroud comprises at least one coding element for defined mating with a plug-in connector element. The coding element may be implemented for example as a projection and/or as a recess.

One embodiment provides that the contact pins are bent off. A predefined angle allows the two components, for example cards that are to be connected by the plug connection adapter according to the invention, to be given a defined orientation.

One embodiment provides that at least one catch hook, that snaps into a corresponding recess in the plug-in connector element when the header shroud is fitted, is provided on at least one header shroud. Preferably, two catch hooks are arranged on one header shroud. In certain cases, catch hooks that snap into corresponding recesses in the plug-in connector elements are arranged on both header shrouds of the plug connection adapter. The latching mechanism ensures that the header shroud on the one end of the plug connection adapter will be retained in its defined position when a printed-wiring board is pulled off the header shroud on the other end of the plug connection adapter.

Other advantageous embodiments and further developments of the plug connection adapter will become apparent from further dependent claims and from the specification that follows.

Figure 1:
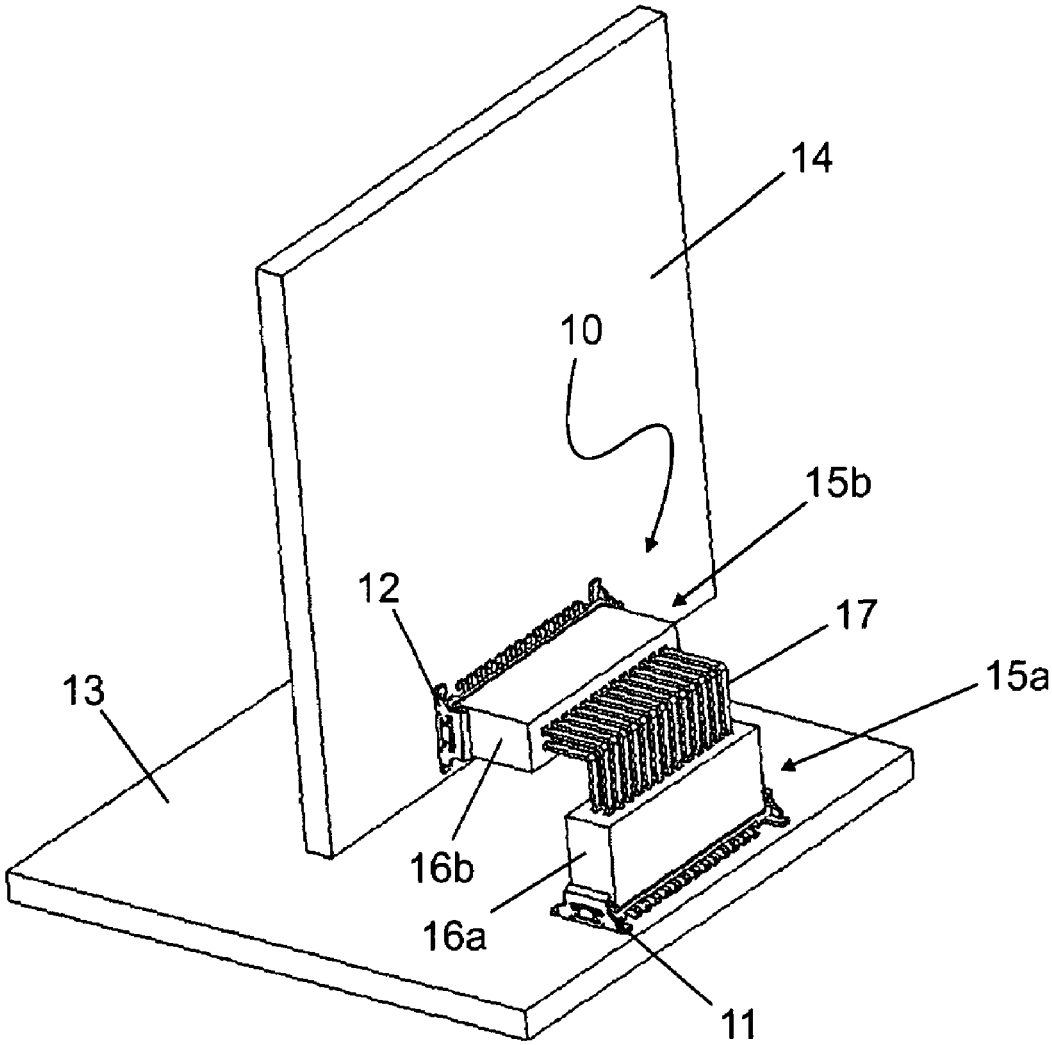
FIG. 1 shows a perspective view of a plug connection adapter according to the invention.

FIG. 1 shows a perspective view of a plug connection adapter 10 suited for connecting a first with a second plug-in connector element 11, 12. The first plug-in connector element 11 is associated to a first component 13, the second plug-in connector element 12 to a second component 14. At least one of the components 13, 14 may be a card. In the illustrated embodiment, the two components 13, 14 are arranged at an angle of 90 degrees, for example, one relative to the other.

The plug connection adapter 10 carries on at least one of its ends 15*a*, 15*b* a header shroud 16*a*, 16*b* that encloses a plurality of contact pins 17. In principle, the plug connection adapter 10 may comprise only a single contact pin 17. In the illustrated embodiment, the plug connection adapter 10 is shown to be fitted on both the first plug-in connector element 11 and the second plug-in connector element 12. Correspondingly, the plug connection adapter 10 comprises a first header shroud 16*a* on its one end 15*a* and a second header shroud 16*b* on its other end 15*b*.

Figure 2:
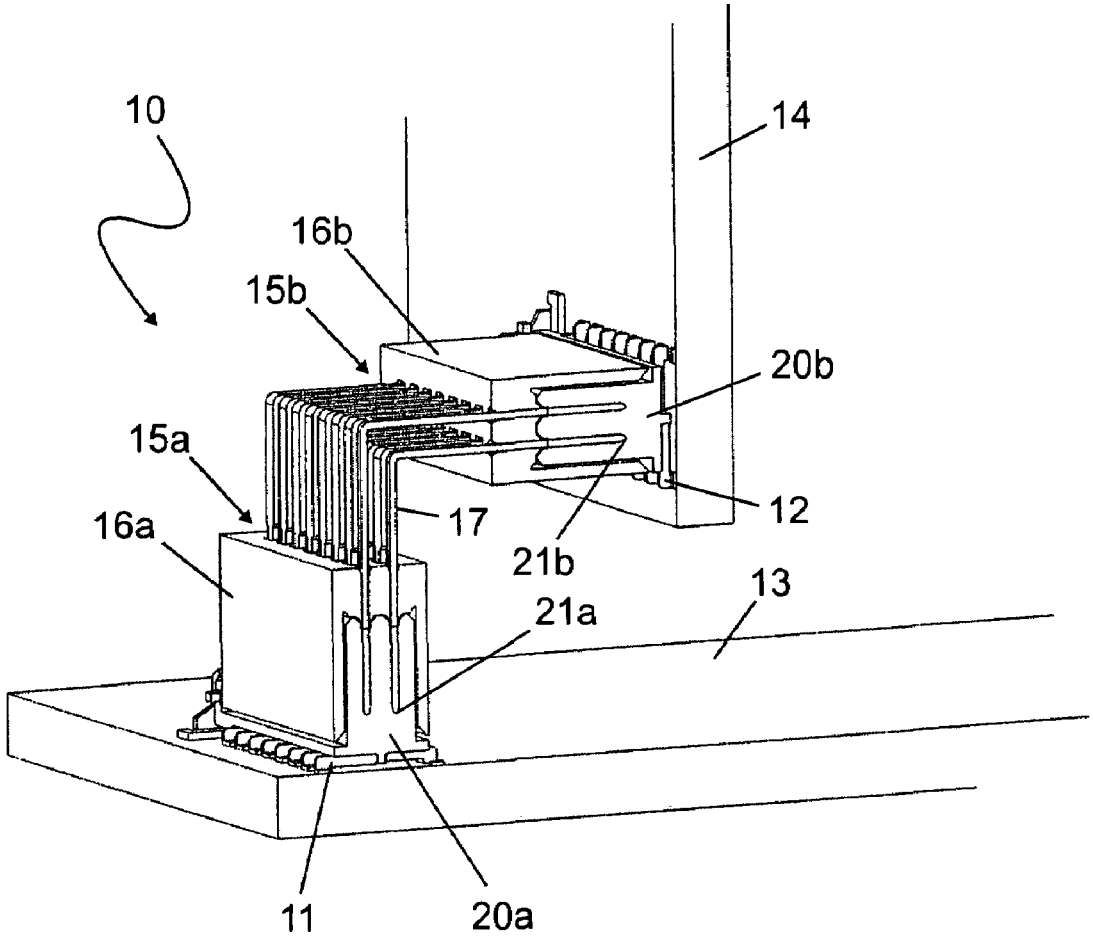
FIG. 2 shows a sectional view of a plug connection adapter according to the invention.

FIG. 2 shows a sectional view of the plug connection adapter 10 according to the invention where those parts of FIG. 2 that conform with the parts of FIG. 1 are indicated by the same reference numerals.

FIG. 2 shows the arrangement of the contact pins 17 in the header shroud 16*a*, 16*b*. Further, FIG. 2 shows the arrangement of the contact pins 17 in a first female block 20*a* of the first plug-in connector element 11 or in a second female block 20*b* of the second plug-in connector element 12, i.e. with the plug connection adapter 10 in contact with the first and the second plug-in connector elements 11, 12.

In the illustrated embodiment, both ends of the contact pins 17 are provided with contact blades 21*a*, 21*b* that enter the female blocks 20*a*, 20*b*. In principle, the opposite arrangement—not shown—would also be possible, in which case the plug connection adapter 10 according to the invention would be provided with contact pins 17 carrying contact slots on their ends that enter into corresponding male blocks of the plug-in connector elements 11, 12 for contact-making.

Figure 3A:
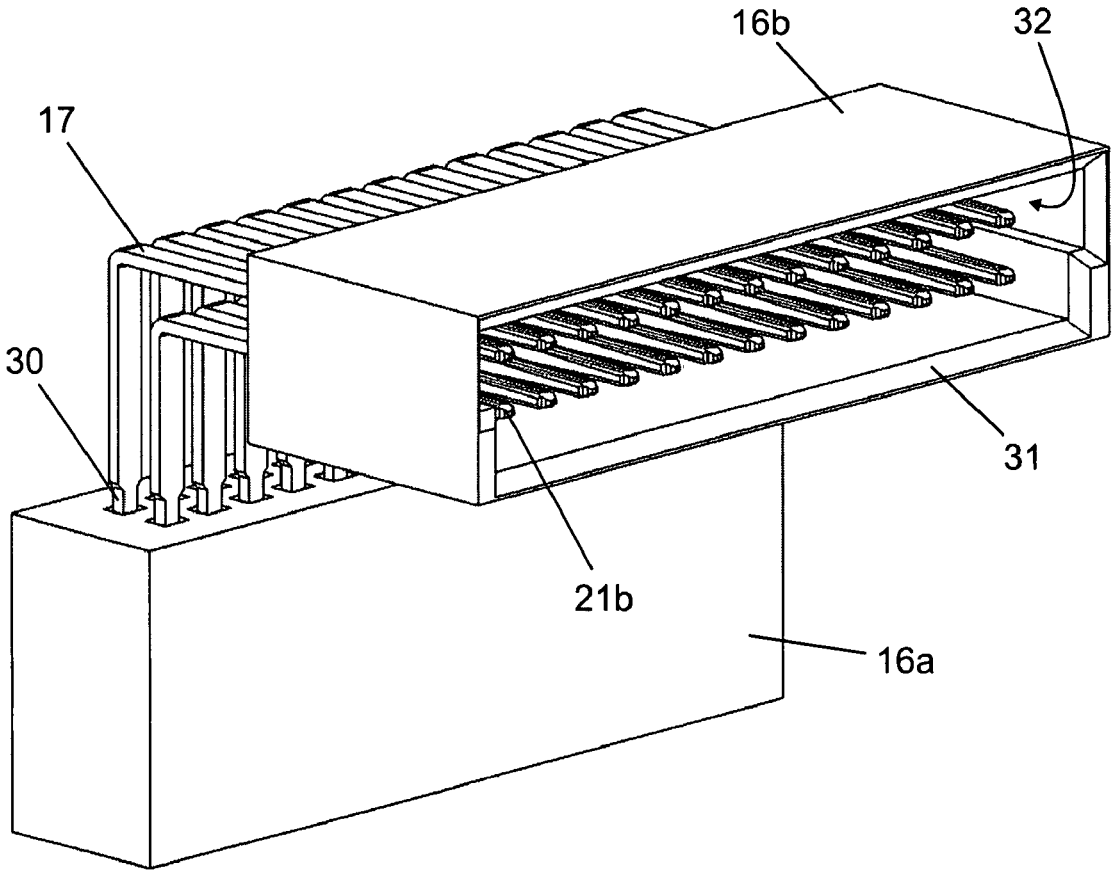
FIG. 3A shows a perspective view of a plug connection adapter according to the invention with bent-off contact pins.
Figure 3B:
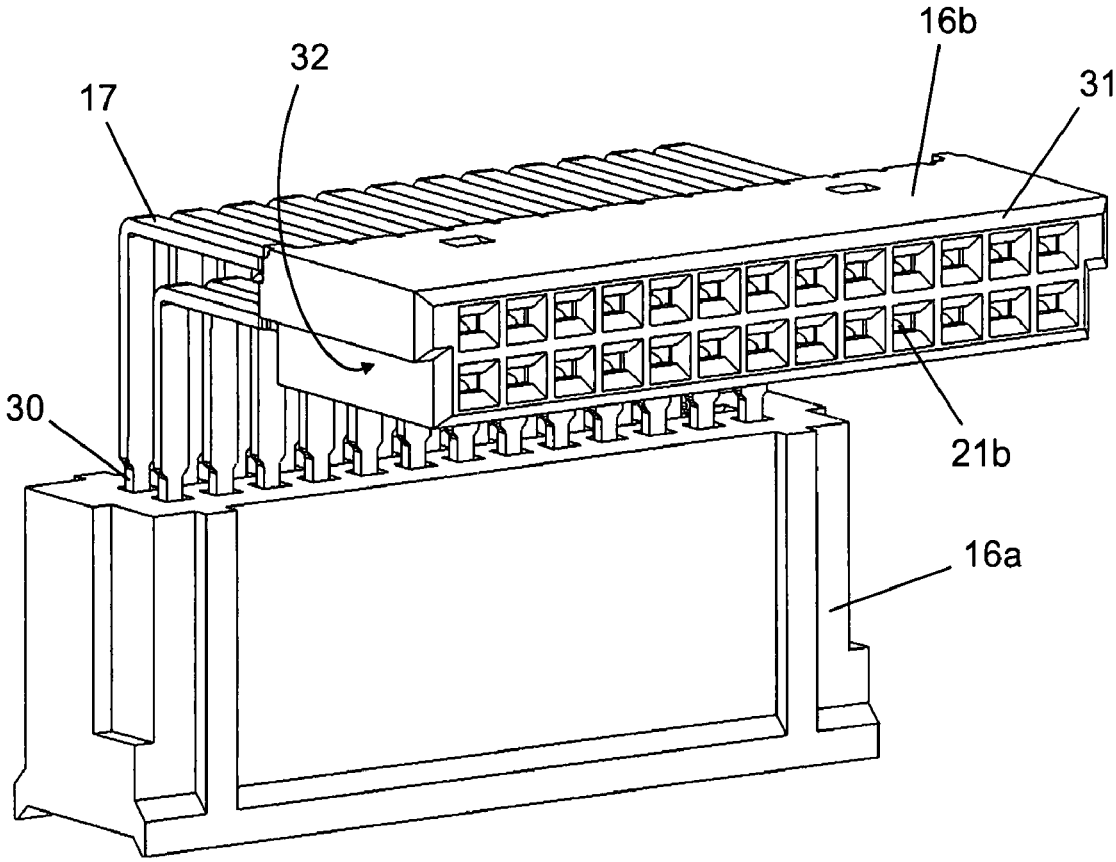
FIG. 3B shows a perspective view of a plug connection adapter according to the invention with contact slots.

FIG. 3 shows an embodiment of the plug connection adapter 10 with bent-off contact pins 17. In the illustrated embodiment, an angle of at least approximately 90 degrees has been defined. In principle, however, any angle can be predefined, depending on the particular job. The plug connection adapter 10 according to the invention thus allows the two components 13, 14 to be arranged not only at a defined spacing, but also in defined orientation/at a defined angle one relative to the other, and the spacing and the orientation/angle may be varied within a broad range.

The contact pins 17 may comprise a narrower portion 30 that permits the first and/or the second header shroud 16*a*, 16*b* to be easily pushed onto the contact pins 17. Preferably, the contact pins 17 are connected with the first and/or the second header shroud 16*a*, 16*b* by a form fit. That form fit may be realized for example by fixing the contact pins 10 in the first and/or the second header shroud 16*a*, 16*b* by an adhesive. Preferably, the first and/or the second header shrouds 16*a*, 16*b* are extrusion-coated around the contact pins.

The larger cross-section of the contact pins 17 in the area between the first and the second header shrouds 16*a*, 16*b* increases the mechanical stability of the plug connection adapter 10 according to the invention. Further, the larger cross-section of the contact pins 17 contributes toward achieving a low ohmic resistance. In addition, the larger cross-section may reduce the inductive reactance, especially in the case of a rectangular cross-section. The illustrated embodiment is based on a rectangular cross-section. In principle, however, any other cross-section, for example a circular cross-section, would likewise be possible.

According to one embodiment, the first and/or the second header shrouds 16*a*, 16*b* comprise at least one sloping edge 31. The sloping edge 31 facilitates the operation of centering the plug connection adapter 10 relative to the plug-in connector elements 11,12 and, consequently, the operation of pushing the first and/or the second header shrouds 16*a*, 16*b* onto the plug-in connector element 11, 12.

According to a different embodiment, the first and/or the second header shrouds 16*a*, 16*b* comprise at least one coding element 32. The coding element 32 may be implemented as a projection and/or a recess, as shown in the embodiment illustrated in FIG. 3. The coding element 32 prevents the first and/or the second header shrouds 16*a*, 16*b* from being pushed onto the first or the second plug-in connector element 11, 12 in incorrect alignment.

Figure 4:
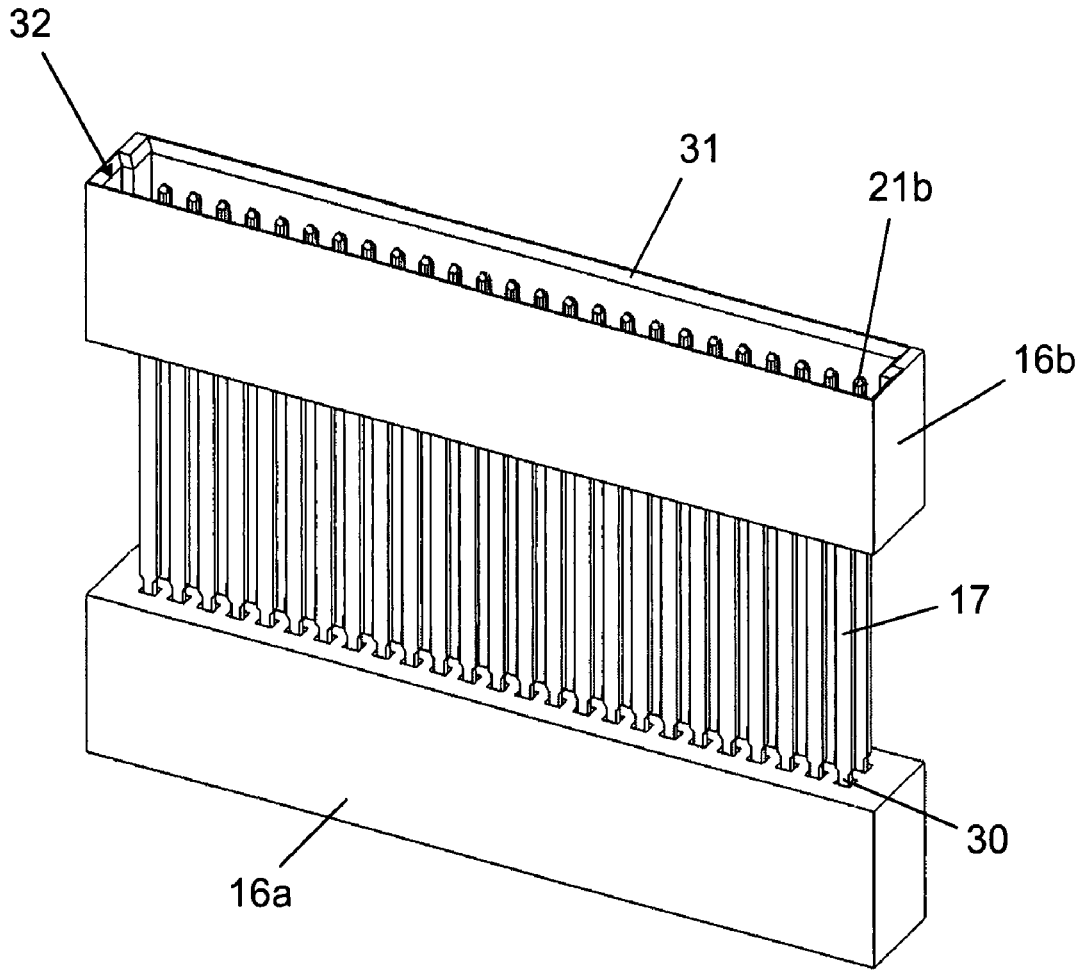
FIG. 4 shows a perspective view of a plug connection adapter according to the invention with straight contact pins.

FIG. 4 shows an embodiment of the plug connection adapter 10 with straight contact pins 17, the parts illustrated in FIG. 4 that correspond to the parts illustrated in the previously described Figures being indicated by the same reference numerals.

In the embodiments illustrated in FIG. 2 and in FIGS. 3 and 4, the ends of the contact pins 17 are shown as contact blades 21*a*, 21*b*. As has been mentioned before, contact slots may be provided instead of the contact blades 21*a*, 21*b*. For example, one could imagine an embodiment where contact slots are provided in the first header shroud 16*a* and contact blades are provided in the second header shroud 16*b*. In principle, even a mixed arrangement of contact blades and contact slots in the first and/or the second header shrouds 16*a*, 16*b* would also be imaginable.

Figure 5:
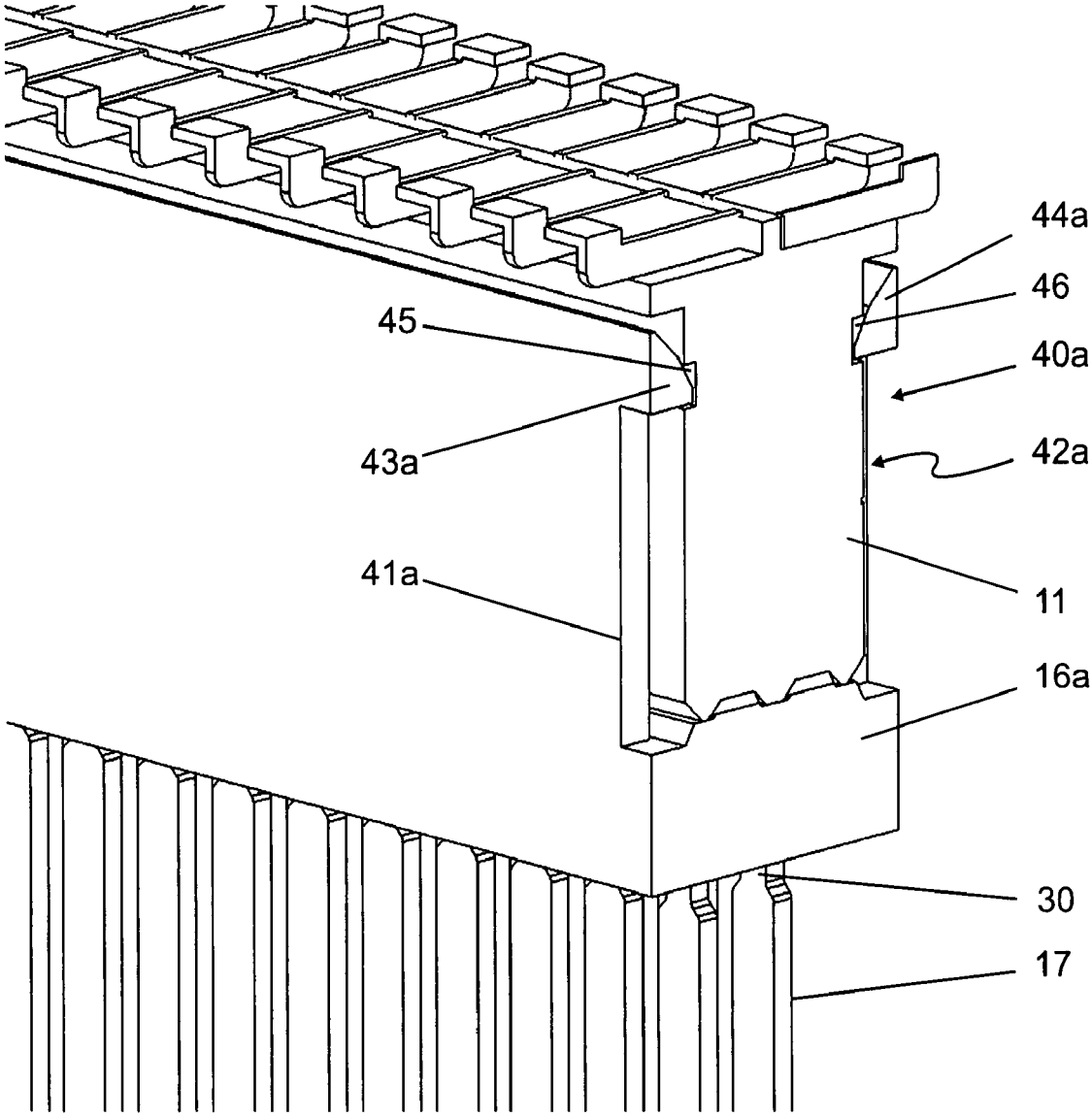
FIG. 5 shows a perspective view of a plug connection adapter according to the invention with two catch hooks snapped into recesses of a plug-in connector element.

FIG. 5 shows an embodiment of the plug connection adapter 10 with a latching mechanism for fixing the first and/or the second header shrouds 16*a*, 16*b* in the mounted condition on the plug-in connector element 11, 12. The embodiment illustrated in FIG. 5 starts out from the assumption that the first header shroud 16*a* has been pushed onto the first plug-in connector element 11.

The first header shroud 16*a* comprises a first open end face 40*a* so that a first left-hand leg 41*a* and a first right-hand leg 42*a*—not visible in FIG. 5—are produced, being formed by the lateral boundary faces of the first header shroud 16*a*.

A first left-hand catch hook 43*a* is formed integrally on the first left-hand leg 41*a*, whereas a first right-hand catch hook 44*a* is formed integrally on the first right-hand leg 42*a*. When the first header shroud 16*a* is pushed onto the first plug-in connector element 11, the first left-hand catch hook 43*a* engages a corresponding left-hand recess 45*a* provided in the first plug-in connector element 11. Correspondingly, the first right-hand catch hook 44*a* engages a corresponding right-hand recess 46 provided in the first plug-in connector element 11.

The latching mechanism secures the position of the first/second header shrouds 16*a*, 16*b* of the plug connection adapter 10 according to the invention on the first/second plug-in connector element 11, 12 when the header shroud 16*a*, 16*b* is pulled off the second/first plug-in connector element 11, 12 or is pushed onto the second/first plug-in connector element 11, 12 on the other end 15*a*, 15*b* of the plug connection adapter 10. Consequently, the first/second header shroud 16*a*, 16*b*, locked on the first/second plug-in connector element 11, 12, is retained in its defined position during assembly on the other end 15*a*, 15*b* of the plug connection adapter 10.

Figure 6:
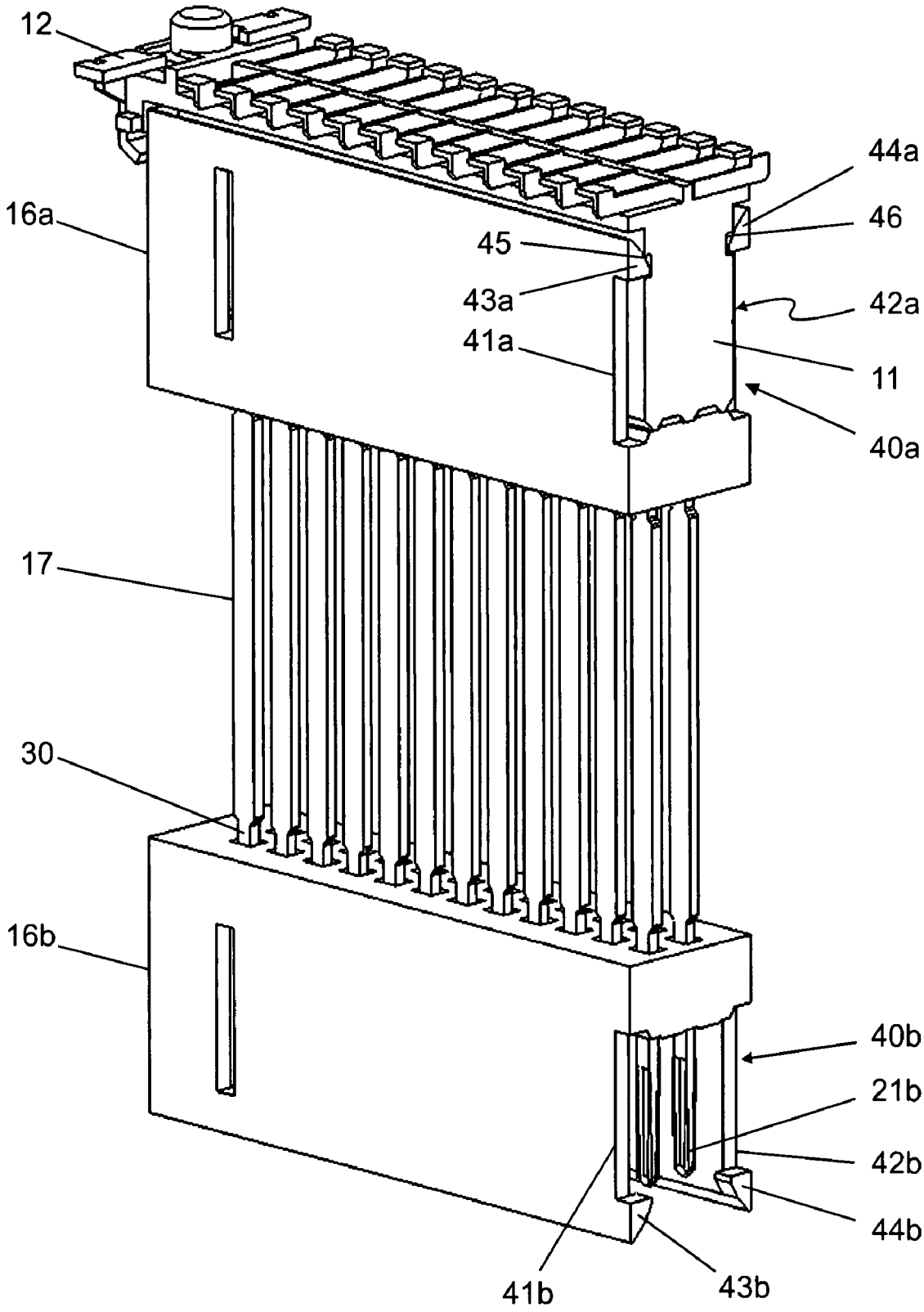
FIG. 6 shows a perspective view of a plug connection adapter according to the invention with catch hooks on both header shrouds.

FIG. 6 shows an embodiment of the plug connection adapter 10 according to the invention where both the first and the second header shrouds 16*a*, 16*b* comprise catch hooks 43*a*, 44*a*; 43*b*, 44*b*.

The second header shroud 16*b* comprises a second open end face 40*b* so that the second left-hand leg 41*b* and the second right-hand leg 42*b* are produced, formed by the lateral surfaces of the second header shroud 16*b*, respectively.

While the first header shroud 16*a* comprises the first left-hand and the first right-hand hooks 43*a*, 44*a*, a second catch hook 43*b* and a second right-hand catch hook 44*b* are provided on the second header shroud 16*b*. The arrangement of this embodiment likewise may be such that a single right-hand or left-hand catch hook 43*a*, 44*a*; 43*b*, 44*b* is provided only on the first and the second header shrouds 16*a*, 16*b*, respectively. For reasons of symmetry it is, however, preferred that a left-hand and a right-hand catch hook 43*a*, 44*a*; 43*b*, 44*b* are formed integrally on the first and the second header shrouds 16*a*, 16*b* of this embodiment as well.

In FIG. 6, the second header shroud 16*b* is shown to have a catch hook 43*b*, 44*b* formed only in the area of the second open end face 40*b*. According to a different embodiment, not shown in detail, the second left-hand and/or the second right-hand catch hooks 43*b*, 44*b* may extend over a greater length or even over the full length of the second left-hand leg 41*a* and/or the second right-hand leg 42*b*. The first left-hand and/or the first right-hand catch hooks 43*a*, 44*a* of the first header shroud 16*a* may then have a corresponding configuration.

Further, it may be provided that the at least one catch hook 43*a*, 44*a*; 43*b*, 44*b* is formed integrally only on the respective open end face 40*a*, 40*b*. For reasons of symmetry, it may be provided in this case that both end faces of the header shroud 16*a*, 16*b* are open and that at least one catch hook 43*a*, 44*a*; 43*b*, 43*b* is formed in these areas.

Figure 7:
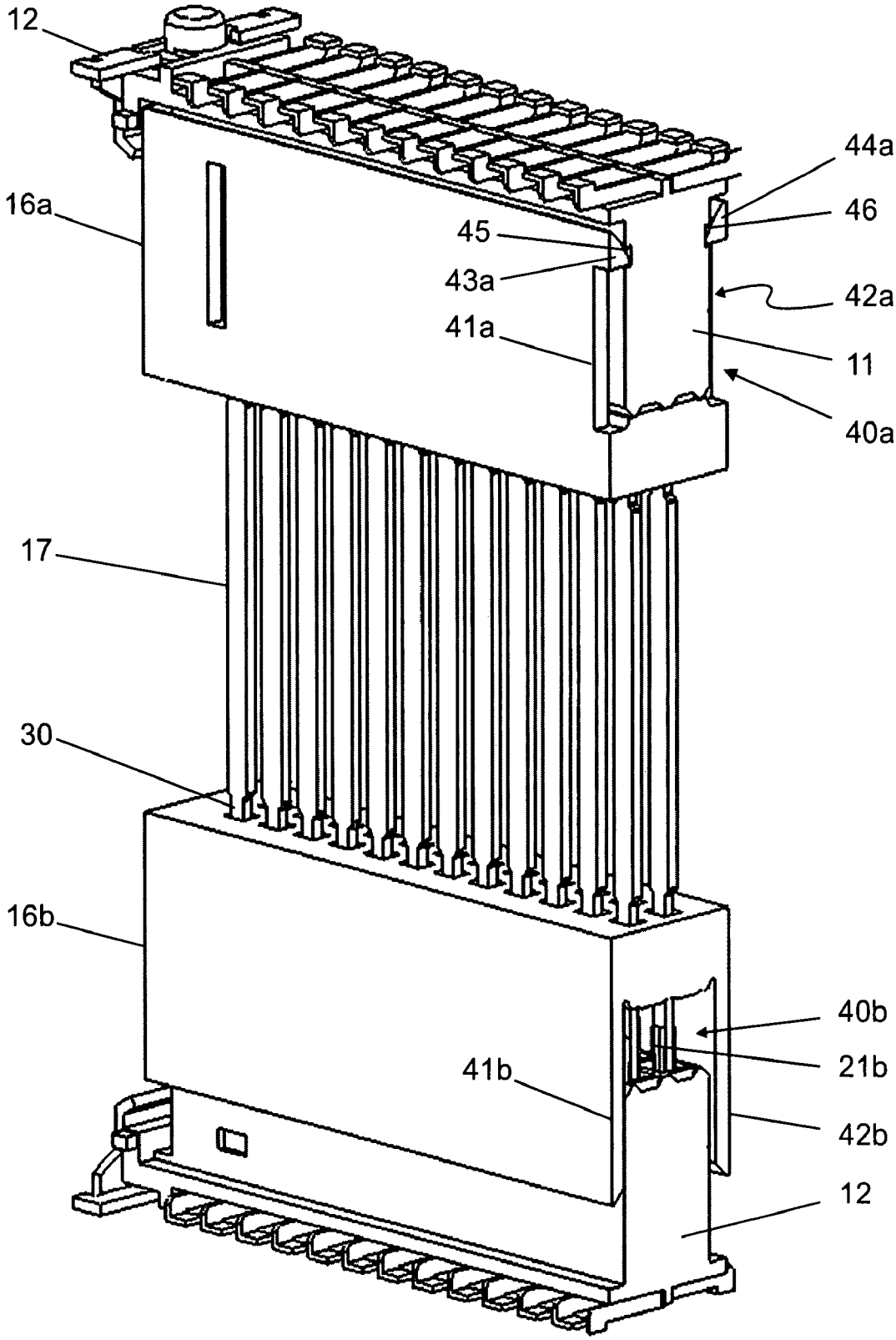
FIG. 7 shows a perspective view of a plug connection adapter according to the invention with catch hooks on one header shroud.

FIG. 7 shows an embodiment where the plug connection adapter 10 comprises catch hooks 43*a*, 44*a* only on the first or on the second header shroud 16*a*, 16*b*. In the illustrated embodiment it has been assumed that a first left-hand catch hook 43*a*/or a first right-hand catch hook 44*a* is provided on the first header shroud 16*a*. Further, it has been assumed that the at least one catch hook 43*a*, 44*a* is formed integrally at least in the area of the first open end face 40*a*.

The second header shroud 16*a* is illustrated in the condition in which it has been pushed onto the second plug-in connector element 12 over approximately half of its length. If desired, a header shroud 16*a*, 16*b*, in the illustrated embodiment the second header shroud 16*b*, which does not comprise a catch hook, may also comprise an open end face, in the illustrated embodiment the second open end face 40*b*.

The invention claimed is:

1. A plug connection adapter adapted for connecting a first plug-in connector element and a second plug-in connector element comprising:

(a) first and second plug connection adapter ends;

(b) at least one contact pin having first and second contact pin ends, each contact pin end having a respective contact element selected from the group consisting of a contact blade and a contact slot for contact-making of the plug-in connector elements; and (c) a first header shroud arranged on said first plug connection adapter end and a second header shroud arranged on said second plug connection adapter end, said header shrouds being spaced from each other and directly connected to each other via said at least one contact pin so that the at least one contact pin forms a continuous connection between said header shrouds;

wherein said at least one contact pin comprises a narrower portion for pushing on one of said first and second header shrouds;

wherein each header shroud comprises at least one coding element for defined mating with a plug-in connector element.

2. The plug connection adapter as defined in claim 1, wherein the header shroud is connected with the contact pin by a form fit.

3. The plug connection adapter as defined in claim 1, wherein the header shroud comprises at least one sloping edge intended to facilitate the operation of pushing the shroud onto a plug-in connector element.

4. The plug connection adapter as defined in claim 1, wherein the at least one contact pin is bent off.

5. The plug connection adapter as defined in claim 1, wherein at least one catch hook, that snaps into a corresponding recess in the mounted condition of the header shroud on the plug-in connector element, is provided on one header shroud.

6. The plug connection adapter as defined in claim 5, wherein two catch hooks are formed integrally on one header shroud.

7. The plug connection adapter as defined in claim 5, wherein at least one catch hook is formed integrally on the first and the second header shroud, respectively.

8. The plug connection adapter as defined in claim 5, wherein at least one catch hook is formed integrally only on one header shroud of the plug connection adapter.

9. The plug connection adapter as defined in claim 5, wherein at least one open end face is provided on at least one header shroud and wherein the at least one catch hook is formed integrally on at least one leg of the header shroud in the area of the open end face.

* * * * *